United States Patent [19]

Kinik et al.

[11] 3,955,510

[45] May 11, 1976

[54] SHELVING APPARATUS

[76] Inventors: Mukerrem Kinik, 2040 Russett Way, West Vancouver, British Columbia; Yalcin A. Eroglu, 990 Balsam St., White Rock, British Columbia, both of Canada

[22] Filed: Dec. 13, 1974

[21] Appl. No.: 526,630

[52] U.S. Cl. ..... 108/111; 46/31; 52/285; 52/582; 52/650; 52/758. D; 108/114; 211/188; 211/194; 312/108; 403/171; 403/218

[51] Int. Cl.[2] ..... A47B 47/00; F16B 5/12

[58] Field of Search ..... 211/148, 177, 182; 108/111, 101, 107, 114, 153; 46/21, 31; 312/140.4, 263, 108, 111; 403/219, 171, 172, 176, 218; 217/65; 52/282, 285, 582, 585, 650, 758 D

[56] References Cited

UNITED STATES PATENTS

| | | | |
|---|---|---|---|
| 1,040,270 | 10/1912 | Bryning | 312/111 X |
| 1,926,268 | 9/1933 | Dummer | 312/263 |
| 2,284,458 | 5/1942 | Van Antwerp | 46/21 X |
| 2,658,776 | 11/1953 | Wilcox | 403/219 X |
| 2,739,414 | 3/1956 | Cleveland | 46/31 X |
| 3,315,639 | 4/1967 | Close | 217/65 X |
| 3,687,500 | 8/1972 | Silvius | 46/31 X |
| 3,854,259 | 12/1974 | Lechene | 52/582 X |
| 3,855,748 | 12/1974 | Thomas | 46/31 |
| 3,874,133 | 4/1975 | Silvius | 52/285 X |

FOREIGN PATENTS OR APPLICATIONS

| | | | |
|---|---|---|---|
| 3,646 | 2/1913 | United Kingdom | 46/31 |
| 927,960 | 11/1947 | France | 46/31 |
| 1,311,963 | 11/1962 | France | 108/111 |

*Primary Examiner*—Roy D. Frazier
*Assistant Examiner*—William E. Lyddane
*Attorney, Agent, or Firm*—Fetherstonhaugh & Co.

[57] ABSTRACT

Shelving apparatus including vertical shelving elements and horizontal shelving elements that are releasably interconnected by connectors formed of stiff material. The shape of the connectors depends upon the shelving arrangement to be erected, and there are connectors of L formation, of T formation, and + formation. Each connector comprises a body having arms extending outwardly from a mid portion thereof and substantially normal to each other, a slot in each of said arms extending from near the mid portion and opening outwardly from outer ends of the arms and from sides thereof to receive the shelving elements. The body of each connector is shaped between the arm slots to reinforce the arms.

11 Claims, 12 Drawing Figures

SHELVING APPARATUS

Figure 1:
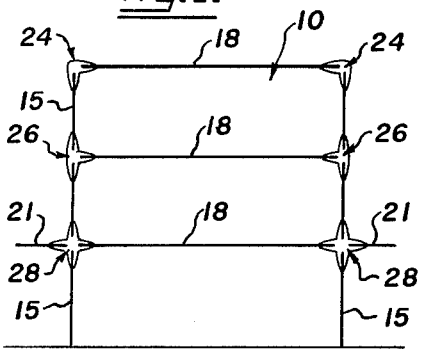

This invention relates to shelving apparatus which can be quickly and easily erected or dismantled without the need for any special skills, tools or fastening elements in the form of nails, screws or the like.

The main purpose of the present invention is the provision of shelving apparatus which enables shelving to be erected in an infinite number of designs by the use of special connectors which eliminate the necessity for tools, screws or the like, and professional skill. The shelving can be erected and dismantled merely by the utilization of hand pressure. In addition to this, the erected shelving has a pleasant and decorative appearance.

The prior art includes adjustable and demountable shelving. But the prior shelving includes bolts, screws or nails as fastening elements, and these necessitate the use of tools. In addition, some of the prior shelving includes framing which has to be cut to suit a particular shelving arrangement, while others have vertical shelving elements that are cut in accordance with the height of the shelving to be produced.

The present shelving system includes specially designed connectors which may be utilized to produce an infinite number of shelving designs. The apparatus includes vertical and horizontal shelving elements which can be produced in modular lengths so that shelving of any desired height or width can be erected without any cutting operations. This allows shelving units to be dismantled and then erected in different shapes and designs, and this can be done very quickly and easily and without any special skills.

The connectors of this shelving apparatus are preferably formed of suitable plastics material. In the preferred form of the invention, this material is transparent and colourless, and the shelving elements are preferably made of transparent and colourless glass or plastics material so that a very pleasant effect is attained when the shelving is erected. It has been found that polycarbonate is very suitable for the connectors since it is very strong, rigid or stiff, and yet is slightly resilient. This slight resiliency enables the shelving elements to be easily inserted in slots in the connectors, and yet the material of the connectors grips the shelving elements so that these elements cannot accidentally come apart.

As stated above, the shelving elements of this apparatus are preferably modular so that the height, length, width or shape of a shelving unit can be altered merely by adding, subtracting, or substituting the shelving elements. There is no framework to be constructed, altered or replaced, and the shelving elements and connectors can be used over and over again. As the shelving elements and the connectors can be formed of clear transparent material, the erected shelving does not appear to have any connectors or supports and thereby provides a novel effect. The erected shelving units can be used for any desired purpose, such as retail display units, storage racks, sales counters, and decorative units for business or household purposes.

Shelving apparatus in accordance with the present invention comprises a body formed of stiff material, said body having arms extending outwardly of the body from a mid portion thereof and substantially normal to each other, a slot in each of said arms extending from near said mid portion and opening outwardly from outer ends of the arms and from sides of said arms to receive shelving elements, said body being shaped between the arm slots to reinforce said arms.

More specifically, the present shelving apparatus comprises at least one vertical shelving element, at least one horizontal shelving element extending at right angles to the vertical element, and at least one connector interconnecting the vertical element and the horizontal element, said connector comprising a body formed of stiff material, said body having arms extending outwardly of the body from a mid portion thereof and substantially normal to each other, a slot in each of said arms extending from near said mid portion and opening outwardly from outer ends of the arms and from sides of said arms to receive said vertical and horizontal shelving elements, said body being shaped between the arm slots to reinforce said arms.

Figure 2:
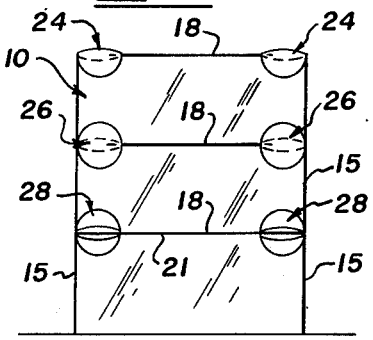
Figure 3:
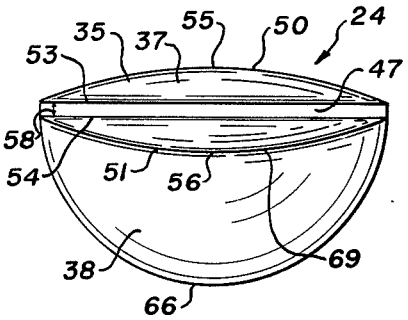
Figure 4:
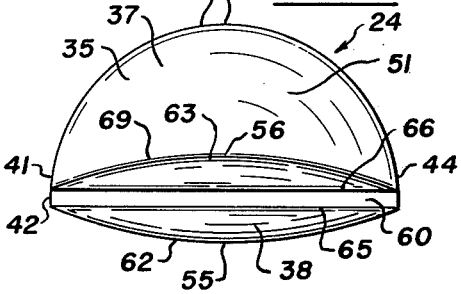
Figure 5:
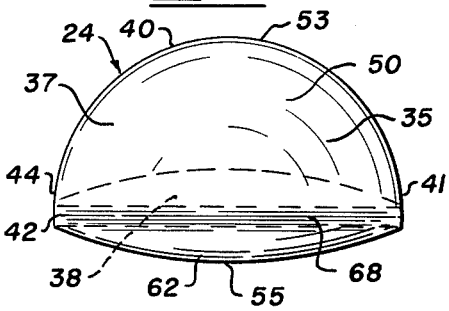
Figure 6:
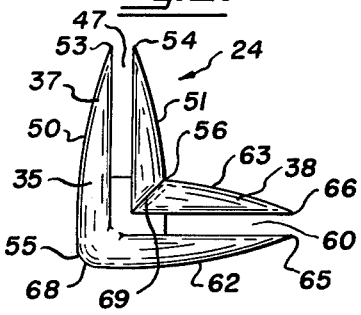
Figure 7:
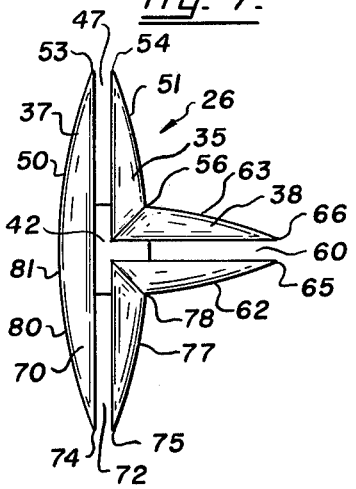
Figure 8:
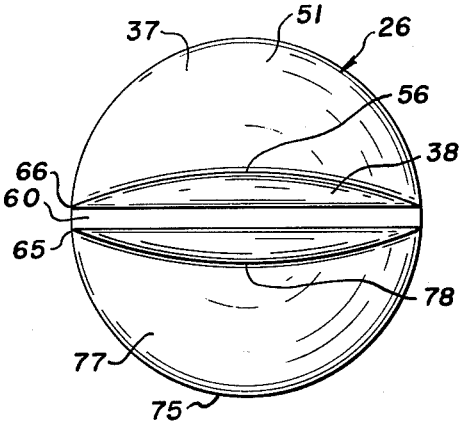
Figure 9:
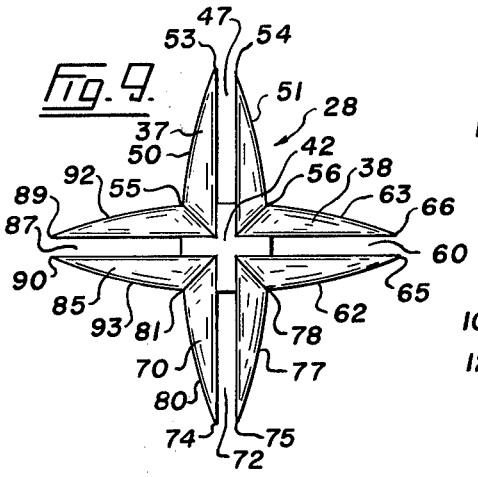
Figure 10:
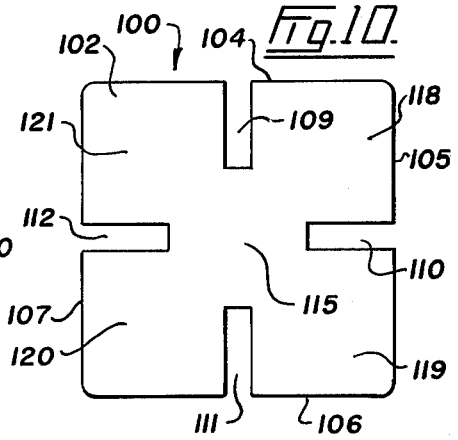
Figure 11:
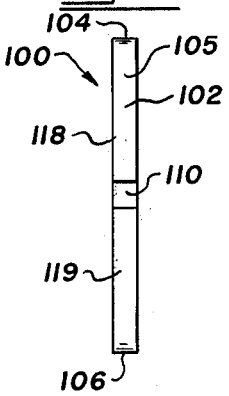
Figure 12:
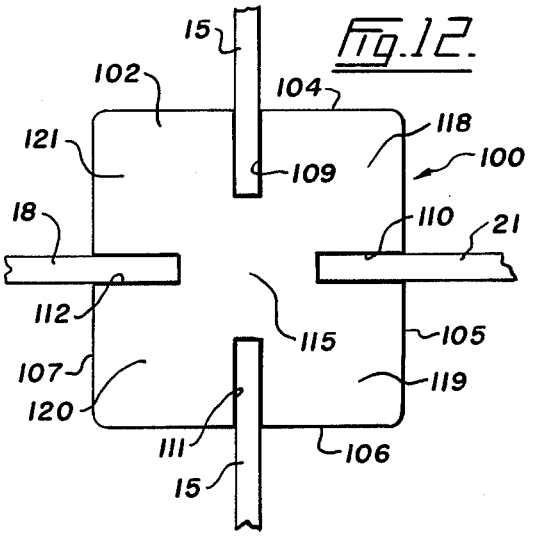

Examples of this invention are illustrated in the accompanying drawings, in which FIG. 1 is a diagrammatic front elevation of an illustrative form of shelving unit incorporating the shelving apparatus of this invention, FIG. 2 is a diagrammatic end elevation of the shelving unit of FIG. 1, FIG. 3 is a plan view of one form of connector of this apparatus FIGS. 4, 5 and 6 are front, back and end elevations of the connector of FIG. 3, FIG. 7 is an end elevation of a variation of the connector of FIG. 3, FIGS. 8 and 9 are plan and end elevations of still another modification of the connector of FIG. 3, FIG. 10 is a front elevation of an alternative form of connector for this shelving apparatus, FIG. 11 is an end elevation of the connector of FIG. 10, and FIG. 12 is a diagrammatic view of the connector of FIG. 10 interconnecting vertical and horizontal shelving elements.

Referring to FIGS. 1 and 2 of the drawings, 10 is assembled shelving apparatus in accordance with this invention and illustrated one of the infinite number of designs that can be created by this invention. Shelving apparatus 10 includes a plurality of vertical shelving elements 15, a plurality of inner horizontal shelving elements 18, and a plurality of outer horizontal shelving elements 21. Apparatus 10 also includes three similar but slightly different types of connectors 24, 26 and 28. Each connector 24 is of substantially L formation, each connector 26 of substantially T formation, and each connector 28 of substantially + formation. In this example, connector 24 interconnects a vertical shelving element 15 and a horizontal shelving element 18, while connector 26 interconnects two aligned vertical elements 15 to a horizontal element 18, while connector 28 interconnects two aligned vertical elements 15 to two aligned horizontal elements 18 and 21. In this arrangement, a plurality of vertical elements 15 constitute the vertical supports of apparatus 10, while horizontal elements 18 and 21 constitute shelves for the unit.

Horizontal shelving elements 18 and 21 may be formed of any suitable material, such as glass or plastics material, while the connectors 24, 26 and 28 are preferably formed of a clear transparent plastic material, such as polycarbonate. The connectors are shaped to blend in with the shelving elements, and yet are quite strong, and interconnect these elements so that they will not come apart, unless subjected to definite pulling actions in the right directions. By referring to FIGS. 1 and 2, it will be seen that there preferably is a connector at each corner of the shelving elements. It is obvious that apparatus 10 can be made any desired height merely by using the required number of vertical elements 15. Similarly, the width of apparatus 10 can be increased by utilizing connectors 26 at one end of the uppermost shelving element 15, and utilizing connectors 28 to interconnect aligned horizontal elements 18 at one set of the vertical elements 15.

FIGS. 3 to 6 illustrate connector 24 in detail. This connector comprises a body 35 formed of stiff plastics material which is preferably slightly resilient. The body includes two identical arms 37 and 38 arranged substantially at right angles to each other. Arm 37 is formed with a curved edge 40 that extends from one side 41 of the arm near the mid portion 42 of the body around the outer end 43 of the arm to the opposite side 44 of the arm near said mid portion 42, see FIGS. 4 and 5. A slot 47 is formed in arm 37 and extends outwardly from near mid portion 42 of the connector body and opens outwardly from the sides 41 and 44 and the outer end 43 of the arm. This slot is wide enough to receive vertical and horizontal elements 15 and 18, and is preferably slightly narrower than the thickness of these elements so that the latter have to be forced into the slot by hand.

Arm 37 is formed with outer dome-shaped faces 50 and 51 that curve from thin edges 53 and 54 outwardly to central points 55 and 56 at the base or inner end of the arm. The narrow edges 53 and 54 are on opposite sides of slot 47 and constitute a narrow edge indicated in FIG. 3 by reference numeral 58 of the arm through which the slot opens outwardly. In other words, arm 37 is relatively thick at the inner end thereof where it joins the inner end of arm 38, and tapers towards sides 41 and 44 of the arm and outer end 43 thereof to the thin edges 53 and 54. Thus, the arm is thick at the center of body 35 where most strength is needed, and tapers out to thin edges 53 and 54 which more or less blend with the shelving element in slot 47.

Arm 38 is a duplicate of arm 37, and has a slot 60 therein which opens outwardly from the sides and outer ends of the arm. In addition, arm 38 is formed with outer dome-shaped faces 62 and 63 which taper outwardly from thin edges 65 and 66 to the center points 55 and 56 of the body. It will be noted that outer surface 62 of arm 38 is connected to the outer surface 50 of arm 37 by a curved section 68. It will also be noted that curved surface 63 of arm 38 connects with the outer curved surface 51 of arm 37 along a curved line 69 that passes through center point 56. The dome shapes of outer surfaces 50, 51, 62 and 63 of the arms of connector 24 act as reinforcements for said arm. The force of any prying effort of shelving elements in slots 47 and 60 is transferred to the centerpoint 55 and 56 of the connector body where said body is relatively thick and able to stand a great deal of strain without breaking. These curved outer surfaces not only provide bracing or reinforcing, but they give the connector a pleasant appearance, which is assisted by the curves of thin edges 53, 54, 65 and 66. In addition, these edges tend to blend into the shelving elements in slots 47 and 60, and as they are very thin, they do not provide flat surfaces against which articles can knot to endanger the shelving unit.

Connector 26 is illustrated in FIGS. 7 and 8. This connector is substantially the same as connector 24, and has arms 37 and 38 with their slots 47 and 60. The difference in connector 26 is that it is provided with a third arm 70 which is exactly the same as arm 37, but is aligned therewith and extends away therefrom, as clearly shown in FIG. 7. Arm 70 has a slot 72 therein which extends from near the mid portion 42 of the connector body 35 outwardly and opens out from the sides and outer end of the arm at thin edges 74 and 75 of the latter. Arm 70 has a dome-shaped outer surface 77 which extends outwardly from thin edge 75 to a midpoint 78 of the body where it joins the outer surface 62 of arm 38. Arm 70 also has a dome-shaped outer surface 80 which extends from thin outer edge 74 through center point 81 of the body. It will be noted that outer surface 80 of arm 70 and outer surface 50 of arm 37 form a continuous dome-shaped curve extending between thin edges 53 and 74.

With connector 26 in the position shown in FIG. 7, it is ready to receive vertical shelving elements 15 in its slots 47 and 72, and a horizontal shelving element 18 in its slot 60.

FIG. 9 illustrates connector 28 in detail. This connector is substantially the same as connector 26, but it is formed with an arm 85 in addition to arms 37, 38 and 70. Arm 85 is aligned with and extends away from arm 38. Arm 85 has a slot 87 therein extending outwardly from the mid portion 42 of body 35 of the connector to the outer edge of the arm formed by thin edges 89 and 90. This arm 85 also has outer dome-shaped faces 92 and 93 which extend inwardly from thin edges 89 and 90 to the center points 55 and 81 of the body. As seen in FIG. 9, slots 47, 60, 72 and 87 are in substantially+ formation. Slots 47 and 72 are ready to receive vertical shelving elements 15, while slots 60 and 87 are ready to receive either two horizontal shelving elements 18, or an element 18 and an outer horizontal shelving element 21. Body 35 is very thick at its mid portion 42 where all of the stresses to which the connector is subjected are directed by the dome-shaped outer surfaces of the four arms.

FIGS. 10, 11 and 12 illustrate an alternative form of connector 100 which may be used in place of the connectors 24, 26 and 28.

Connector 100 has a body in the form of a flat plate 102 which preferably is rectangular in shape and has side edges 104, 105, 106 and 107. In this example, the connector is formed with four slots 109, 110, 111 and 112 which are arranged substantially at right angles to each other and extend outwardly from the mid portion 115 of body 102 respectively to the edges 104, 105, 106 and 107 thereof. The body or plate 102 is preferably formed of a suitable plastics material, such as polycarbonate. The portions of body 102 containing slots 109, 110, 111 and 112 constitute the arms of this connector.

With connector 100 in the position shown in FIGS. 10 and 12, slots 109 and 111 are positioned to receive vertical shelving elements 15, while slots 110 and 112 are arranged to receive horizontal shelving elements 18 and 21.

Connector 100 can be formed with slots 109 and 110 only, or with slots 109, 110 and 111 only. In either case, it can retain its rectangular shape, or in the first instance the body or plate 102 can be of L shape formation, and in the second instance it can be of T shape formation. In the illustrated example, the body or plate 102 is of + formation.

The material of plate 102 at 118 between slots 109 and 110, at 119 between slots 110 and 111, at 120 between slots 111 and 112, and at 121 between slots 112 and 109 forms reinforcement for the portions of the plate containing the slots and which constitute the arms of this connector. It will be noted that mid portion 115 of the body or plate is relatively large so that it can withstand without breaking considerable force which may be transmitted thereto through the plate material as a result of a levering action of shelving elements in the slots of the connector.

If connector 100 is utilized to interconnect only two or three shelving elements, a portion of the plate containing the unused slots or slot projects outwardly from the shelving. However, this provides an ornamental effect, and it not detrimental to the operation of the connector.

When it is desired to erect a shelving unit of a given design, the required number of shelving elements 15 and 18, and if necessary elements 21, are assembled, along with the required number of connectors 24, 26, 28 and/or 100. In order to interconnect the vertical shelving elements and the horizontal shelving elements, it is only necessary to insert the elements in the desired connector slots. These shelving elements are presssed into their respective slots by hand. The nature of the plastics material from which the connectors are made is such that it tends to grip the shelving elements in the slot so that they will not easily slide out of the slots, and yet when it is desired to dismantle the shelving unit, the shelving elements can be pulled out of the connector slots by hand. Thus, it will be seen that a shelving unit of any desired design or size can be quickly and easily assembled or dismantled by hand. Furthermore, if it is desired to increase or decrease the size of a given shelving unit, this can be easily done by adding or substracting the necessary shelving elements.

We claim:

1. Shelving apparatus for decoratively and securely interconnecting shelving elements and vertical elements in a shelving structure, comprising a body formed of stiff, slightly resilient material, said body having arms extending outwardly therefrom from a mid portion thereof and substantially normal to each other, a slot in each of said arms extending from near said mid portion and opening outwardly from outer ends of the arms and from sides of said arms to receive said elements and resiliently grip the latter, each of said arms being formed with outer dome-shaped faces that curve from thin edges of the arm outwardly to substantially the centre of the arm at the inner end thereof so that said each arm has narrow edges through which the slot of said arm opens outwardly and increases in thickness from said edges to said body centre, said dome-shaped faces reinforcing the arm and transferring the force of any prying or tipping effort of said elements to said body centre where the body is relatively thick as a result of the dome shape of the arm faces.

2. Shelving apparatus as claimed in claim 1 in which the body and arms are arranged in substantially L formation, and the dome-shaped arm faces which constitute the outer surface of the body meet at the joint formed by the arms to thicken and reinforce the body at said joint.

3. Shelving apparatus as claimed in claim 1 in which the body and arms are arranged in substantially T formation with two of said arms aligned and a third one of said arms perpendicular to the aligned arms, and the dome-shaped faces of the two aligned arms which constitute an outer surface of the body extend in an outer substantially continuous curve from a thin edge of one of the latter arms to a thin edge of the other of the latter arms to thicken the body at the joint formed by the arms to reinforce the body at said joint.

4. Shelving apparatus as claimed in claim 1 in which the body and arms are arranged in substantially cross formation, and the dome-shaped arm faces which constitute the outer and inner surfaces of the body meet at the joint formed by the arms to thicken and reinforce the body at said joint.

5. Shelving apparatus as claimed in claim 1 in which each arm has a curved edge extending from one side of the arm near the mid portion of the body around the outer end of the arm to the other side thereof near said mid portion.

6. Shelving apparatus comprising at least one vertical shelving element, at least one horizontal shelving element extending at right angles to the vertical element, and at least one connector interconnecting the vertical element and the horizontal element, said connector comprising a body formed of stiff, slightly resilient material, said body having arms extending outwardly therefrom from a mid portion thereof and substantially normal to each other, a slot in each of said arms extending from near said mid portion and opening outwardly from outer ends of the arms and from sides of said arms to receive said elements and resiliently grip the latter, each of said arms being formed with outer dome-shaped faces that curve from thin edges of the arm outwardly to substantially the centre of the arm at the inner end thereof so that said each arm has narrow edges through which the slot of said arm opens outwardly and increases in thickness from said edges to said body centre, said dome-shaped faces reinforcing the arm and transferring the force of any prying or tipping effort of said elements to said body centre where the body is relatively thick as a result of the dome shape of the arm faces.

7. Shelving apparatus comprising a plurality of vertical shelving elements, a plurality of horizontal shelving elements extending at right angles to the vertical elements, and a plurality of connectors interconnecting the vertical elements to the horizontal elements, each connector comprising a body formed of stiff, slightly resilient material, said body having arms extending outwardly therefrom from a mid portion thereof and substantially normal to each other, a slot in each of said arms extending from near said mid portion and opening outwardly from outer ends of the arms and from sides of said arms to receive said elements and resiliently grip the latter, each of said arms being formed with outer dome-shaped faces that curve from thin edges of the arm outwardly to substantially the centre of the arm at the inner end thereof so that said each arm has narrow edges through which the slot of said arm opens outwardly and increases in thickness from said edges to said body centre, said dome-shaped faces reinforcing the arm and transferring the force of any prying or tipping effort of said elements to said body centre where the body is relatively thick as a result of the dome shape of the arm faces.

8. Shelving apparatus as claimed in claim 6 in which the body and arm of at least one connector are arranged in substantially L formation, and the dome-shaped arm faces which constitute the outer surface of the body meet at the joint formed by the arms to thicken and reinforce the body at said joint.

9. Shelving apparatus as claimed in claim 6 in which the body and arms of at least one connector are arranged in substantially T formation with two of said arms aligned and a third one of said arms perpendicular to the aligned arms, and the dome-shaped faces of the two aligned arms constitute an outer surface of the body extending in an outer substantially continuous curve from a thin edge of one of the latter arms to a thin edge of the other of the latter arms to thicken the body at the joint formed by the arms to reinforce the body at said joint.

10. Shelving apparatus as claimed in claim 6 in which the body and arms of at least one connector are arranged in substantially cross formation, and the dome-shaped arm faces which constitute the outer and inner surfaces of the body meeting at the joint formed by the arms to thicken and reinforce the body at said joint.

11. Shelving apparatus as claimed in claim 6 in which each arm of at least one connector has a curved edge extending from one side of the arm near the mid portion of the body around the outer end of the arm to the other side thereof near said mid portion.

* * * * *